US009310174B2

(12) United States Patent
Perez Cordova et al.

(10) Patent No.: US 9,310,174 B2
(45) Date of Patent: Apr. 12, 2016

(54) SIGNAL TRANSMISSION TUBE WITH INVERSE INITIATION RETENTION SEAL METHOD

(76) Inventors: Pio Francisco Perez Cordova, Lima (PE); Jose William Palomino Cahuana, Lima (PE)

( * ) Notice: Subject to any disclaimer, the term of this patent is extended or adjusted under 35 U.S.C. 154(b) by 0 days.

(21) Appl. No.: 14/351,638

(22) PCT Filed: Jul. 25, 2012

(86) PCT No.: PCT/PE2012/000003

§ 371 (c)(1),
(2), (4) Date: Apr. 14, 2014

(87) PCT Pub. No.: WO2013/055239

PCT Pub. Date: Apr. 18, 2013

(65) Prior Publication Data

US 2015/0107476 A1 Apr. 23, 2015

(30) Foreign Application Priority Data

Oct. 14, 2011 (PE) ..... 1801-2011/DIN

(51) Int. Cl.

| | |
|---|---|
| ***F42B 3/10*** | (2006.01) |
| ***F42D 1/04*** | (2006.01) |
| ***F42B 3/087*** | (2006.01) |
| ***C06C 5/04*** | (2006.01) |

(52) U.S. Cl.

CPC . *F42D 1/043* (2013.01); *C06C 5/04* (2013.01); *F42B 3/087* (2013.01); *F42D 1/04* (2013.01)

(58) Field of Classification Search

CPC ..... F42B 3/195; F42B 3/107; F42D 1/043; C06C 7/00

USPC ..... 102/275.1, 215, 439, 275.3, 275.11, 102/276, 206

See application file for complete search history.

(56) References Cited

U.S. PATENT DOCUMENTS

| | | | | |
|---|---|---|---|---|
| 3,306,201 | A * | 2/1967 | Noddin | F42B 3/10 102/275.3 |
| 3,590,739 | A | 7/1971 | Persson | |
| 4,729,316 | A * | 3/1988 | Evrard | F42C 15/21 102/248 |
| 5,173,569 | A * | 12/1992 | Pallanck | F42B 3/122 102/210 |
| 8,079,296 | B2 * | 12/2011 | Barton | E21B 43/1185 175/4.56 |
| 8,187,397 | B2 * | 5/2012 | Perez Cordova et al. | 149/46 |
| 8,261,663 | B2 * | 9/2012 | Perez Cordova et al. | 102/215 |
| 2007/0228703 | A1 * | 10/2007 | Breed | 280/735 |

(Continued)

FOREIGN PATENT DOCUMENTS

WO PCT/US2011/027639 3/2011

*Primary Examiner* — Michael David

(74) *Attorney, Agent, or Firm* — Jesus Sanchelima, Esq.; Christian Sanchelima, Esq.

(57) ABSTRACT

A non-electric detonator connected to similar detonators with capsule 2 with having charge 8 and delay train 9. A tube 3 for transmitting a shock wave having an internal surface with a predetermined amount of a propagating explosive has one end mounted within capsule 2 adjacent to delay train 9. A seal 12 formed by collapsing a portion of tube 3 at a distance from its end prevents a shock wave accidentally created at capsule 2 from propagating to the rest of tube 3. Yet, the propagation of the wave is not prevented when it comes from the other end of tube 3. The distance from end 13*a* where seal 12 is formed needs to be selected for a predetermined explosive amount not sufficient to propagate the wave from capsule 2 but enough to propagate it when the wave comes from the other end.

3 Claims, 4 Drawing Sheets

(56) References Cited

U.S. PATENT DOCUMENTS

2008/0243342 A1* 10/2008 Breed ..... 701/45
2011/0120603 A1* 5/2011 Perez Cordova et al. ..... 149/46
2011/0155012 A1* 6/2011 Perez Cordova et al. ..... 102/215
2013/0112098 A1* 5/2013 Plitt ..... C06C 7/00
102/276
2014/0227548 A1* 8/2014 Myrick ..... 428/570

* cited by examiner

A
B
3
13
6
7
13
3a
3b
12
10
9
8
2
11
13a
13a

SIGNAL TRANSMISSION TUBE WITH INVERSE INITIATION RETENTION SEAL METHOD

OTHER RELATED APPLICATIONS

The present application is a continuation-in-part of PCT patent application Serial No. PCT/PE2012/000003, filed on Jul. 25, 2012, claiming international priority based on Peruvian patent application serial No. 1801-2011/DIN, filed on Oct. 14, 2011, which are hereby incorporated by reference.

BACKGROUND OF THE INVENTION

1. Field of the Invention

The present invention relates to a signal transmission tube that has an inverse initiation retention seal that prevents the inverse propagation of an unintended shock wave and attenuates the creation of induced electrostatic charges.

2. Description of the Related Art

Several designs for detonator seals have been designed in the past. None of them, however, include an inverse retention seal built in the propagation tube itself that connects with a seal used with non-electric detonators to prevent unintended accidental detonation.

Detonators of the non-electric type are preferred in many applications, in particular mining, to avoid the inherent problems found with electric detonators such as rampant electrostatic charges induced by weather conditions or equipment nearby. The non-electric detonators typically take advantage of the high speed (1,500 meters per second) of the percussion gaseous waves to synchronized the detonation of various charges by interconnecting these non-electric detonators. Some detonators in the field are located on the surface, or otherwise in places susceptible to their accidental activation (a rock or tree branch falling on the detonator, a truck running over it, etc.). The accidental detonation is then transmitted to the other interconnected detonators creating a bigger problem. Thus, it is desirable to find a way to preventing the detonation of interconnected detonators when an accident causes one of the detonators to be activated. The present invention addresses this problem providing a simple novel solution that was not obvious before.

Fuse apparatuses that utilize transmission tubes have been disclosed in the past. In U.S. Pat. No. 3,590,739 issued to Persson in 1971 discloses the use of a shock tube or duct for propagating a gaseous percussion wave to activate non-electric detonators. There is no provision, however, for preventing the inverse initiation of signals as claimed herein or the suggestion of any seals.

Applicant believes that another related reference corresponds to PCT patent No. PCT/US2011/027639 filed by DYNO NOBEL INC. et al on Mar. 9, 2011 claiming international priority under U.S. Ser. No. 61/311,857 filed on Mar. 9, 2010. However, it differs from the present invention because the seal is not built in the shock tube, at a predetermined distance from its end. And there is no suggestion in the Dyno Nobel reference on preventing the propagation of the shock wave signal in the direction opposite to what the shock tube is designed for. Instead, the reference is concerned with maintaining the explosive pressures providing a gas impermeable seal and obviating the need for an ignition buffer. The seal in the present invention, on the other hand, prevents the propagation of the wave traveling from the detonator accidentally triggered to other detonators connected to the shock tube. There is no suggestion of modifying the shock tube, at a predetermined distance from its end, to prevent the wave from traveling back and initiating additional detonations.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a seal for a shock tube that prevents the inverse initiation of a detonating shock wave.

It is still another object of the present invention to provide a signal propagation tube that is reliable.

It is another object of this invention to provide a signal transmission tube that prevents the unintended propagation of an inverse detonating signal by electrical charges of a predetermined magnitude.

It is yet another object of this invention to provide such a tube that is inexpensive to manufacture and maintain while retaining its effectiveness.

Further objects of the invention will be brought out in the following part of the specification, wherein the detailed description is intended to fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
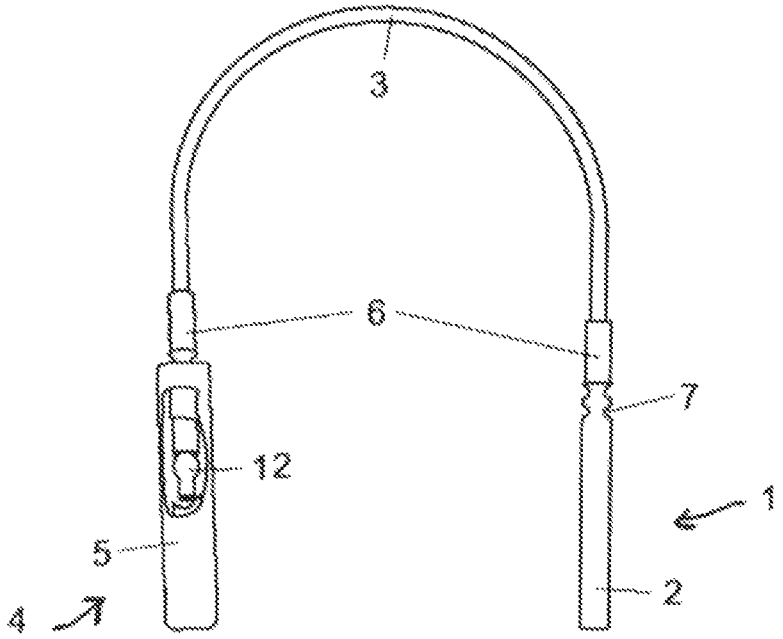
FIG. 1 represents a dual detonation system of the non-electric delay type with a signal transmission tube 3 having the inverse initiation retention seals.

Referring now to the drawings, where the present invention is generally referred to with numeral 1, it can be observed that it basically includes metallic capsule 2 having preferably a cylindrical shape with one open end 13 and closed at the other end 13*a*. Depth detonator 1 is shown in FIG. 1 in one possible configuration connected to surface detonator 4. The object being to prevent the transmission of a shock wave signal from the accidental (truck running over it, a rock falling on it) triggering of surface detonator 4 to depth detonator 1 (and possibly other detonators connected to shock tube 3) to trigger additional unintended detonations.

Figures 2A, 2B:
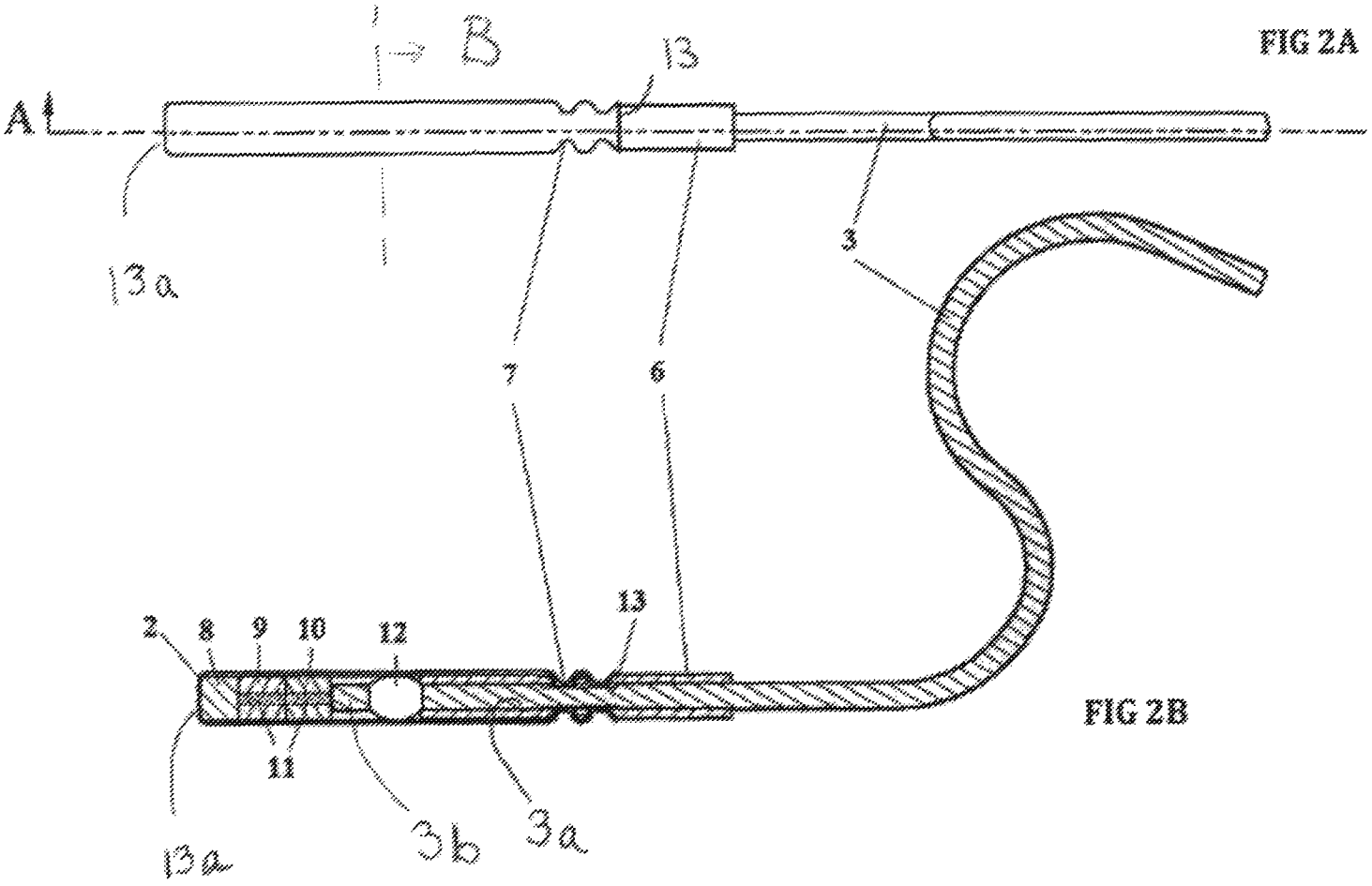
FIG. 2A illustrates top view of a detonator of the non-electric delay type and a portion of the signal transmission tube.
FIG. 2B shows a cross-sectional view taken from section line A in FIG. 2A showing a detonator of the non-electric type mounted at the end of a shock tube with the inverse initiation retention seal located in the tube and at a predetermined distance from its end connected to the detonator.
Figure 2D:
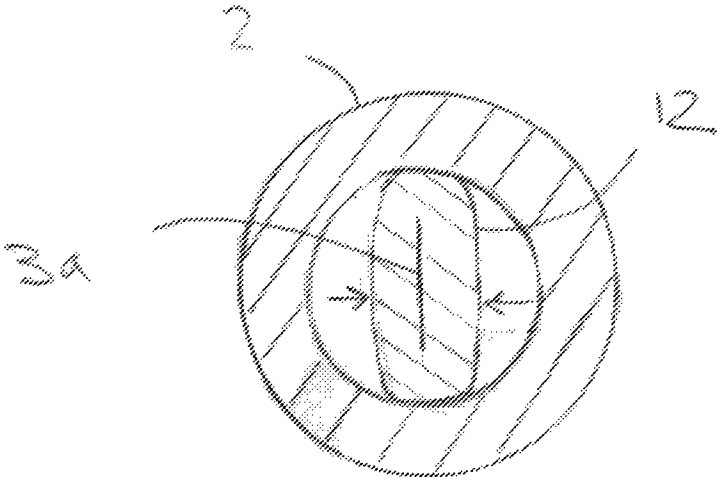
FIG. 2D is a cross-section taken along section line B in FIG. 2A showing the expandable collapsed interior surface of tube 3.
Figure 2C:
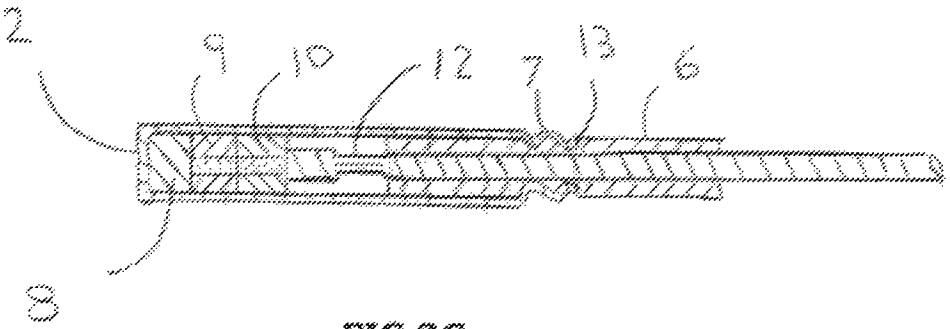
FIG. 2C is similar to FIG. 2B except that the detonator has been axially rotated 90 degrees.
Figure 2E:
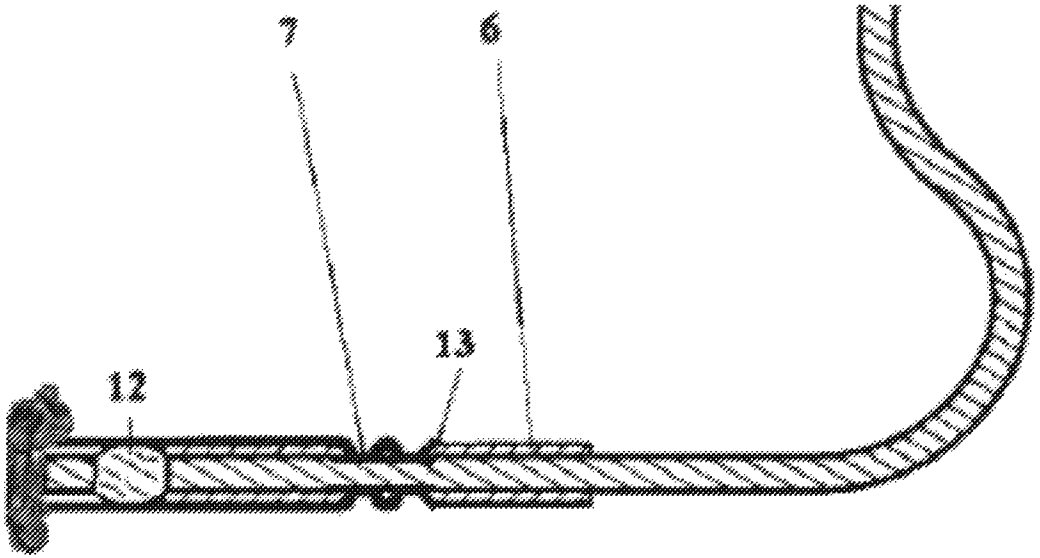
FIG. 2E shows the detonator shown in FIG. 2B after an accidental detonation showing the destroyed end of capsule 2 and consumed portion 3*b* of tube 3 with seal 12 stopping the wave signal.

Inside capsule 2, next to closed end 13*a*, explosive charge 8 is housed, as is conventionally practiced, typically including a primary and a secondary charge. Abuttingly disposed to charge 8 is pyrotechnic delay train 9 and next to it pyrotechnic delay train 10, as seen in FIGS. 2B and 2C. Delay trains 9 and 10 are conventionally used in the field, depending on the applications, to delay the reaction that will eventually reach charge 8.

Shock or signal transmitting tube 3 is used conventionally to transmit a shock or impact wave (also referred to as gaseous percussion or signal) to detonators, such as those referred to the numerals 1 and 4, herein. Shock tubes 3 include one or more layers of plastic material, for example Surlyn® of E.I. Dupont de Nemours, Iotek® made by Exxon Mobil, or equivalent, for the internal layers. And an outer layer of low or medium density polyethylene for the outer layer. These detonators are also described as detonating caps (i.e. numeral 12 in U.S. Pat. No. 3,590,739). Tube 3 includes an internal continuous channel from end to end with its continuous communication interrupted by seal 12, as described below. Tube 3 includes a predetermined amount of a reactive composition that is sufficient to transmit a shock wave at speeds of approximately 1500 meters per second. A thin film of a reactive composition is applied to the interior walls 3*a* of tube 3 and is of sufficient amount to propagate the pressure wave signal but not enough to cause damage in the area surrounding tube 3.

Tube 3 includes end 3*b* that comes in abutting contact and signal transfer relationship with pyrotechnic delay train 10, as seen in FIG. 2B. Seal 12 is formed at a distance of approximately one time the outer diameter of tube 3 defining end portion 3*b* of tube 3. The distance of seal 12 from the end of tube 3 can vary from zero to three times the outer diameter of tube 3 and still obtain good results. The interior of tube 3 is collapsed or flattened to form seal 12 with interior surface 3*a* where seal 12 is defined, as best seen in FIGS. 2C and 2D. Using ultrasound sealing techniques and applying a predetermined amount of pressure to tube 3, interior surface 3*a* is flattened. Good results have been obtained using the equipment marketed by Branson Ultrasonics Corporation (www.Bransonultrasonic.com). The collapsed or flattened portion of tube 3 defining seal 12 can be inflated or expanded upon the application of sufficient gaseous pressure such as the pressure produced from the reaction within tube 3 when sufficient exothermic energy is released. And the exothermic energy released in a conventional ignition of tube 3 is sufficient to expand seal 12 and transfer the signal to portion 3*b* of tube 3 that is adjacent to the end of tube 3 house within capsule 2. However, if detonator 1 or 4 is accidentally activated destroying capsule 2 where charge 8 and the train delays 9 and 10 are housed, then portion 3*b* ignited, the energy and gaseous pressure generated is not sufficient to expand seal 12 and transmit the signal to the rest of tube 3. In this manner, additional unintended activation of other inter-connected detonators is avoided. This is illustrated in FIG. 2D.

The degree to which interior surface 3*a* of tube 3 is collapsed or flattened varies between 0.1 to 0.7 times the outer diameter of tube 3. Preferably, between 0.3 and 0.6 times the exterior diameter of tube 3. The outer diameter is preferably used as a reference in the field to determine how much to flatten tube 3. There is a relationship between the outer diameter and the inner diameter that permits a ready approximation in order to ensure a complete seal and the strength of the seal based on the amount of the linear density of the reactive composition on the inner surface 3*a*. The objective being to seal and interrupt the internal channel of tube 3. Seal 12 has substantially the shape of an ellipse, as seen in elevation in FIG. 2C. The small axis of the ellipse measures between 0.6 and 1.0 times the internal diameter of tube 3. The long axis of the ellipse measures between 0.6 and 1.6 times the inner diameter of tube 3.

The amount of reactive or explosive material deposited on the interior surface 3*a* of portion 3*b*, when the foregoing dimensional characteristics of seal 12 are taken into consideration, is such that it is not sufficient to expand seal 12 enough to transmit a signal to the rest of tube 3.

An adjustment sleeve 6 is used to provide a gas tight engagement along with crimp 7 on capsule or shell 2. Sleeve 6 is made out of a semiconductor material to facilitate the dissipation of induced electrostatic charges through a grounded connection to capsule 2.

Tests performed. Several experiments have been conducted with and without seal 12, at different temperatures, to show the efficacy of the seal claimed herein. The material, explosive and reactive charges were all the same. The results follow:

I. Detonator is Initiated with Tube 3 Conventionally.

TABLE 1

| | | 18 mg/m* | | 12 mg/m* | | |
|---|---|---|---|---|---|---|
| Temp. | Seal | No. of Tests | No Ignition | Ignition Ocurred | No Ignition | Ignition Ocurred |
| +40° C. | Y | 100 | 0 | 100 | 0 | 100 |
| +40° C. | N | 100 | 0 | 100 | 0 | 100 |
| +20° C. | Y | 100 | 0 | 100 | 0 | 100 |
| +20° C. | N | 100 | 0 | 100 | 0 | 100 |
| −5° C. | Y | 100 | 0 | 100 | 0 | 100 |
| −5° C. | N | 100 | 0 | 100 | 0 | 100 |
| −10° C. | Y | 100 | 0 | 100 | 0 | 100 |
| −10° C. | N | 100 | 0 | 100 | 0 | 100 |

*Shock wave tube 3 was impregnated with 18 and 12 mg/m of HMX/Al.

II. Tube 3 is Checked for Transmission of Signal Initiated by Detonator (Inverse).

TABLE 2

| | | 18 mg/m* | | 12 mg/m* | | |
|---|---|---|---|---|---|---|
| Temp. | Seal | No. of Tests | No Signal | Signal Delivered | No Signal | Signal Delivered |
| +40° C. | Y | 100 | 100 | 0 | 100 | 0 |
| +40° C. | N | 100 | 23 | 77 | 35 | 65 |
| +20° C. | Y | 100 | 100 | 0 | 100 | 0 |
| +20° C. | N | 100 | 22 | 78 | 33 | 67 |
| −5° C. | Y | 100 | 100 | 0 | 100 | 0 |
| −5° C. | N | 100 | 24 | 76 | 32 | 68 |
| −10° C. | Y | 100 | 100 | 0 | 100 | 0 |
| −10° C. | N | 100 | 21 | 79 | 30 | 70 |

*Shock wave tube 3 was impregnated with 18 and 12 mg/m of HMX/Al.

Table 1 shows that tube 3 works equally well with or without seal 12. Table 2 shows that, upon the recreating of an accidental initiation at the detonator end, tube 3 without the seal will initiate an unintended signal wave to tube 3 between 76 and 79 times out of 100 when charged at 18 mg/m. And with the lower charge of 12 mg/m between 65 and 70 times out of 100. It is clear that the security contribution of seal 12 is important.

Another important benefit of seal 12 relates to its protection against unintended initiations trigged by electrostatic discharges. These electrostatics discharges may not be dissipated entirely by using an adjustable deformable sleeve or bushing, as described in the Dyno Nobel reference, made out of semiconductor material. By semiconductor it is understood in the field to relate to a sleeve with some electrical conductivity that is capable of dissipating electrostatic charges. Standard testing procedures currently require using a 500 pF capacitor charged to 25,000 volts and connecting it through a 5,000 ohms resistor to represent the charge collected by a human being and a capacitor of 2,500 pF charged to 30,000 volts with a zero ohm resistor to represent the electrostatic charge that a machine could store.

Tests were conducted, showing the results described below, using a 3,800 pF capacitor charged to 40,000 volts with a resistance of zero ohms. One of the contact terminals was connected electrically to capsule 2 and the other terminal was connected to the interior of tube 3, at varying distances, until a discharge (spark) was provoked. The same type of detonator described above, with 25 ms. Pyrotechnic delay train, were used.

III. Tube 3 is Checked for Electrostatic Discharge.

TABLE 3

| Distance (mm) | With seal Initiates? | Without seal Initiates |
|---|---|---|
| 10 | No | Yes |
| 20 | No | Yes |
| 30 | No | Yes |
| 40 | No | Yes |
| 50 | No | Yes |
| 60 | No | No |

The foregoing table shows that using seal 12 provides the added benefit of protecting better the detonator from accidental electrostatic charges.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A detonator device of the non-electric type comprising:

A. a detonator capsule 2 having a tubular elongated shape with an open end 13 and a closed end 13*a* and further including a first explosive charge 8 within said capsule 2, adjacent to said closed end 13*a* and at least one pyrotechnic delay train charge 9 adjacent to said explosive charge 8;

B. a tube 3 for transmitting a shock wave signal having an internal continuous channel and an internal surface 3*a* with a predetermined amount of a second explosive composition impregnated thereon to effectively propagate said wave without destroying said tube, and said tube including first and second ends, said first end connected to at least one detonator of the non-electric type and a first predetermined portion of said tube 3 adjacent to said second end being housed within said capsule 2 with said second end in abutting contact with said at least one delay train charge 9 and a seal 12 for interrupting the continuous communication of the internal channel and preventing the transmission of an inverse shock wave in said tube 3 and said seal 12 being located at a first predetermined distance from said second end defining a second predetermined portion of said tube 3, said seal 12 being an expandable collapsed portion of said internal surface adjacent to said second predetermined portion thereby reducing the communication through said tube 3, and the amount of said second explosive in said second predetermined portion being insufficient to propagate said shock wave from said second end to said first end while permitting the propagation of said wave form said first end to said second end when ignited; and C. a plastic protective cover 5 around said capsule 2 at a third predetermined distance from said open end.

2. The detonator device set forth in claim 1 wherein said seal is located between zero and three times the diameter of said tube away from said second end.

3. The detonator set forth in claim 2 wherein said seal provides a thickness of no less than 0.1 times the external diameter of tube 3 and no more than 0.7 times the external diameter of tube 3.

* * * * *